United States Patent [19]

Kollmai

[11] 4,250,142

[45] Feb. 10, 1981

[54] VOLATILE HYDROCARBON DETECTOR APPARATUS

[76] Inventor: Klaus E. Kollmai, 2824 S. Osage, Wichita, Kans. 67217

[21] Appl. No.: 27,743

[22] Filed: Apr. 6, 1979

[51] Int. Cl.[3] ..... G01N 27/16; G01N 31/12

[52] U.S. Cl. ..... 422/68; 23/230 EP; 23/232 R; 73/23; 422/78; 422/94; 422/98

[58] Field of Search ..... 23/230 EP, 232 R; 73/23; 422/68, 72, 94–98

[56] References Cited

U.S. PATENT DOCUMENTS

| | | | |
|---|---|---|---|
| 2,263,108 | 11/1941 | Stuart | 23/230 EP |
| 2,591,737 | 4/1952 | Souther, Jr. | 23/230 EP |
| 2,663,379 | 12/1953 | Doan | 422/68 X |
| 2,713,010 | 7/1955 | Bonner | 23/230 EP |

*Primary Examiner*—Michael S. Marcus
*Attorney, Agent, or Firm*—Philip A. Rein

[57] ABSTRACT

This invention is a volatile hydrocarbon detector apparatus to continuously sample methane gas in an oil well drilling mud. The detector apparatus includes 1) a gas sampler assembly to gather the methane gas from the drilling mud; 2) a control module assembly to receive and amplify electrical signals from the gas sampler assembly; and 3) a recorder assembly to receive output electrical signals from the control module assembly.

The recorder assembly is of a conventional nature and operates to record on a paper roll the date, time of day and the amount of methane gas present in the drilling mud. The main novelty lies in the gas sampler assembly which includes 1) a hood housing assembly to straddle a flowing channel of drilling mud; 2) a sensing head assembly mounted in the hood housing assembly to measure amount of methane gas therein; and 3) a pump assembly operable to draw inlet air through the sensing head assembly and discharge air into the channel of drilling mud. The discharge air acts to agitate the drilling mud to increase release of methane gas therein to transmit a more accurate measurement of the methane gas to the recorder assembly.

5 Claims, 4 Drawing Figures

VOLATILE HYDROCARBON DETECTOR APPARATUS

PRIOR ART

A patent search was not conducted by the applicant but the combination of (1) a sensing head assembly to sense the presence of methane gas; (2) a control module assembly to receive a signal from the sensing head assembly and amplify same; and (3) a recorder assembly to receive the amplified signal and transmit to a paper roll is well known in the prior art.

The novelty herein lies in the means for agitating the drilling mud and to add air particles to saturate the drilling mud to aid in the release and cause displacement of the methane gas and directing the methane gas to a sensing head assembly.

PREFERRED EMBODIMENT OF THE INVENTION

The volatile hydrocarbon detector apparatus includes (1) a gas sampler assembly to measure the presence of methane gas and produce an output signal; (2) a control module assembly to receive the output signal and amplify same to a second output signal; and (3) a recorder assembly to receive the second output signal and record the date, time and amount of methane gas in the drilling mud. The gas sampler assembly includes a hood housing assembly having a sensing head assembly and a pump assembly mounted therein. The hood housing assembly includes a main support housing with an upper cover assembly connected thereto. The main support housing is of inverted U-shape open at the bottom and operable to straddle a channel of drilling mud and direct methane gas toward the sensing head assembly. The sensing head assembly includes a sensor head member in the main support housing to receive methane gas to produce the output signal. The pump assembly includes a pump member, an air inlet line connected to the pump member, and an air discharge assembly connected to the pump member. The air inlet line is positioned above the sensor head member to draw the air and methane gas thereto. The air discharge assembly includes a discharge line leading from the pump member into the drilling mud, and a discharge head connected to the discharge line and positioned under the main support housing. The pump member is operable to pump air through the drilling mud to agitate same and aid in the release and displacement by air of any methane gas therein. The release methane gas is drawn by the inlet line to the sensor head member to produce the output signal to the recorder assembly. The amount of methane gas in the continuous sample is recorded on the recorder assembly.

OBJECTS OF THE INVENTION

One object of this invention is to provide a volatile hydrocarbon detector apparatus operable to continuously sample the presence of methane gas in an oil well drilling mud.

One other object of this invention is to provide a volatile hydrocarbon detector having a gas sampler assembly operable to agitate a drilling mud sample to increase the release of methane gas therefrom for increased accuracy of measurement thereof.

Another object of this invention is to provide a volatile hydrocarbon detector apparatus operable to pump air into a drilling mud sample to agitate same and increase the release of methane gas therefrom.

Still another object of this invention is to provide a volatile hydrocarbon detector apparatus which includes a gas sampler assembly having a hood housing to straddle a channel of drilling mud, a pump assembly to agitate the drilling mud to increase release of any methane gas therein, and a sensing head assembly to continuously sense the amount of methane gas present and generate an output signal therefrom.

Still, one other object of this invention is to provide a volatile hydrocarbon detector apparatus that removes a maximum of methane gas from a drilling mud sample, is reliable in operation, is compact and easily portable, and durable in construction.

Various other objects, advantages, and features of the invention will become apparent to those skilled in the art from the following discussion, taken in conjunction with the accompanying drawings in which:

FIGURES OF THE INVENTION

Figure 1:
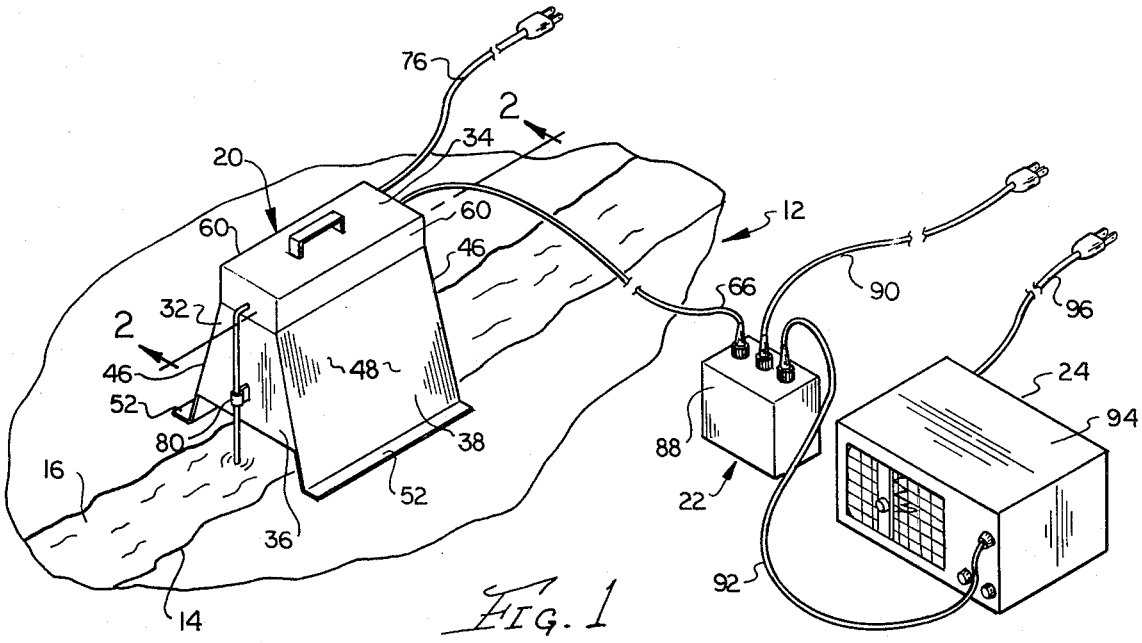
FIG. 1 is a perspective view of a volatile hydrocarbon detector apparatus of this invention illustrated as straddling a channel of oil well drilling mud.

The following is a discussion and description of preferred specific embodiments of the new volatile hydrocarbon detector apparatus of this invention, such being made with reference to the drawings, whereupon the same reference numerals are used to indicate the same or similar parts and/or structure. It is to be understood that such discussion and description is not to unduly limit the scope of the invention.

SPECIFICATION OF THE INVENTION

As shown in FIG. 1, a volatile hydrocarbon detector apparatus, indicated generally at 12, has a portion thereof straddling a channel 14 having oil well drilling mud 16 therein. The function of the detector apparatus 12 is to continuously measure the amount of hydrocarbons, or more specifically, methane gas, present in the drilling mud 16 at any given moment.

This measurement indicates when the drilling bit enters a potential gas reservoir and some of the methane gas, indicated generally at 18, enters the drilling mud 16 and is pumped to the surface to be detected by the detector apparatus 12 of this invention. When the drilling fluid reaches the surface, the pressure drop will cause the trapped or dissolved methane gas 18 to vent into the atmosphere. The detector apparatus 12 aids in the release of the methane gas 18 and therein achieves an accurate measurement thereof.

The volatile hydrocarbon detector apparatus 12 includes (1) a gas sampler assembly 20; (2) a control module assembly 22 to supply power to and receive an output signal from the gas sampler assembly 22; and (3) a recorder assembly 24 connected to receive an output signal from the control module assembly 22. The gas sampler assembly 20 includes a hood housing assembly 26 with a sensing head assembly 28 and a pump assembly 30 mounted therein.

The hood housing assembly 26 includes a main support housing 32 of inverted U-shape having an upper cover assembly 34 connected thereto. The main support housing 32 includes interconnected endwalls 36, sidewalls 38 and a top wall 40. The endwalls 36 have parallel top and bottom edges 42, 44 and downwardly divergent side edges 46.

The sidewalls 38 have outwardly directed, main body sections 48 integral at bottom edges 50 with support legs 52. The support legs 52 extend in a common horizontal plane to provide a support surface for the entire hood housing assembly 26.

The top wall 40 extends in a horizontal plane and provides a support surface for the cover assembly 34.

The cover assembly 34 includes a box-like cover member 54 with a top wall 56 having a handle member 58 connected thereto. The top wall 56 is integral with downwardly depending sidewall members 60 and endwall members 62.

The sensing head assembly 28 includes a sensor head member 64 connected by a cord member 66 to the control module assembly 22.

The sensor head member 64 is a readily available item as is the control module assembly 22 and the recorder assembly 24 and all are fully described in a Report of Investigations No. 7951 by the Bureau of Mines, entitled "A Continuous-Recording Methanometer for Exhaust Fan Monitoring". The three elements of the sensor head member 64, the control module assembly 22, and the recorder assembly 24 are manufactured and sold by the Mine Safety Appliances Company as Methane Detector Model I-514.

Figure 2:
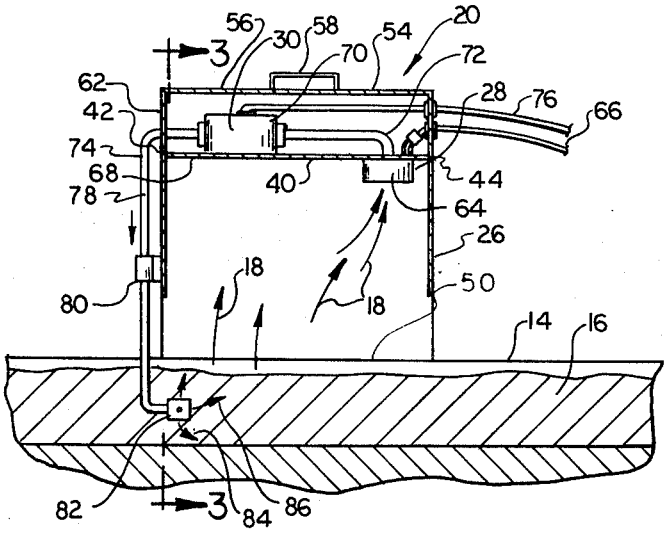
FIG. 2 is a sectional view taken along line 2—2 in FIG. 1.
Figure 3:
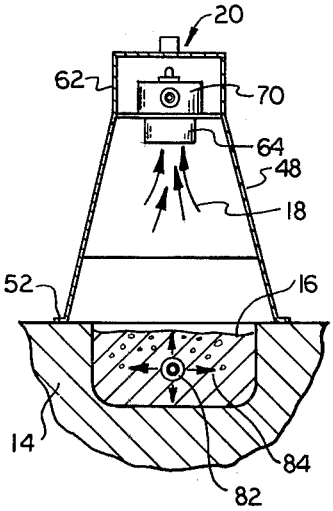
FIG. 3 is a sectional view taken along line 3—3 in FIG. 2.

As noted in FIG. 2, the sensor head member 64 is secured to a bottom surface 68 of the top wall 40 of the main support housing 32 and operably connected to the pump assembly 30.

The pump assembly 30 includes (1) an air pump member 70 mounted on the top wall 40; (2) an air inlet line 72 connected between the pump member 70 and the sensor head member 64; and (3) an air discharge assembly 74 connected to the pump member 70. The air inlet line 72 is mounted through a hole in the top wall 40 and draws any air and methane gas 18 into the sensor head member 64.

The pump member 70 is of a conventional nature to pump air and is connected by a cord member 76 to a 110 volt AC power supply.

The air discharge assembly 74 includes (1) a discharge line 78 connected to the output of the pump member 70; (2) a clamp member 80 securing the discharge line 78 to an endwall 36 on the upstream side of the channel 14 of drilling mud 16; and (3) a discharge head 82 secured to the outer end of the discharge line 78.

The discharge head 82 is a square block member having discharge holes 82 on five (5) sides thereof so that air indicated by arrows 84 and 86 is discharged therefrom. It is noted that the discharge head 82 is positioned within the previously identified endwall 36 to keep the discharged air within the confines of the main support housing 32.

Figure 4:
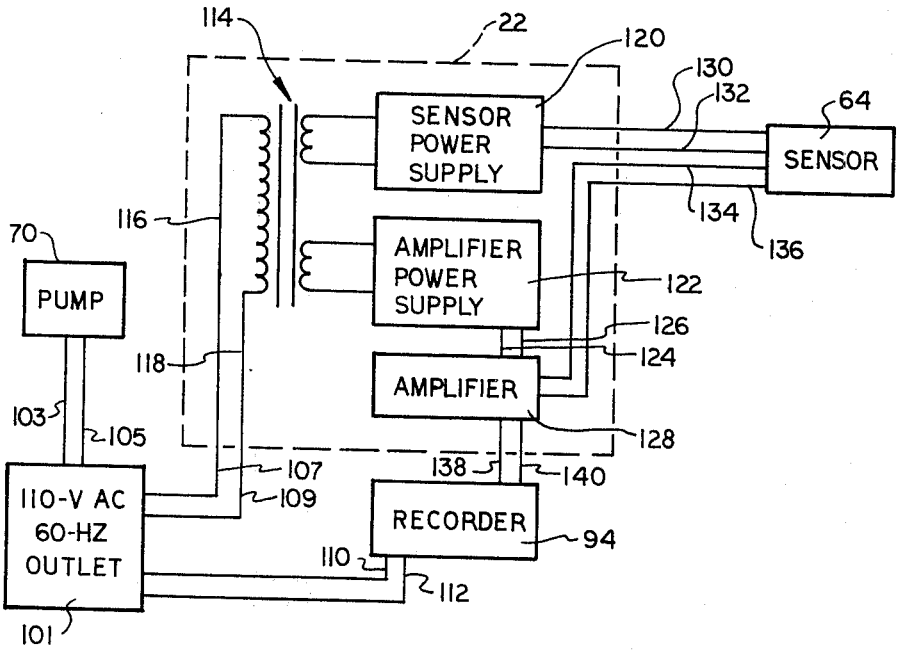
FIG. 4 is an electrical schematic of the volatile hydrocarbon detector apparatus of this invention.

The control module assembly 22 includes a housing 88 having a conventional amplifier circuit mounted therein as described in FIG. 4 and in the Report of Investigations No. 7951 previously described. A power cord member 90 supplies 110 volt AC electrical power to the amplifier circuit. A signal cord member 92 is connected from the control module assembly 22 to the recorder assembly 24 to carry an amplified electrical signal thereto.

The recorder assembly 24 is of a conventional nature such as a Rustrack Model 288 or equal recorder and includes a recorder member 94 energized by a power cord member 96 to a 110 volt AC outlet.

The recorder member 94 may be of a strip chart type to continuously record on a paper roll (1) the date; (2) time of day; and (3) a line indication of the voltage of a signal received from the control module assembly 22 to indicate amount of methane gas 18 present in the drilling mud 16.

An electrical schematic of this invention is shown in FIG. 4 wherein a power supply 101 is (1) connected to the pump member 70 by lines 103, 105 being cord member 76; connected to the module assembly 22 by lines 107, 109 being cord member 90; and connected to the recorder member 94 by lines 110, 112 or cord member 96.

The control module assembly 22 includes a power transformer 114 connected to the lines 116, 118 to supply low voltage DC power to (1) a sensor power supply 120 and (2) an amplifier power supply 122, which supplies power through lines 124, 126 to an amplifier 128.

The sensor power supply 120 supplies low voltage power through lines 130, 132 to the sensor head member 64.

An electrical signal generated by the presence of methane gas at the sensor head member 64 is transmitted by lines 134, 136 to the amplifier 128.

Finally, an amplified electrical signal from the amplifier 128 is transmitted by lines 138, 140 to the recorder member 94 to record the amplified signal on a paper roll in a conventional manner.

USE AND OPERATION OF THE INVENTION

The details of operation of (1 ) the sensor head member 64; (2) the control module assembly 22; and (3) the recorder assembly 24 is described in the Report of Investigations No. 7951 by the Bureau of Mines entitled "A Continuous - Recording Methanometer for Exhaust Fan Monitoring". Therefore, detailed discussion thereof is not deemed necessary.

As shown in FIG. 1, the hood housing assembly 26 is placed to straddle the channel of drilling mud 16. Power is supplied as shown in FIG. 1 to (1) the pump member 70; (2) the control module assembly 22; and (3) the recorder assembly 24.

The hood housing assembly 26 is of substantial length compared to other prior art structures so as to straddle a larger part of the channel 14 having the drilling mud 16 therein. This achieves a more accurate reading of the amount of methane gas therein.

The mere agitation of the drilling mud 16 by the introduction of air under pressure above does not create all of the new, novel and accurate readings of this invention. The drilling mud 16 as it reaches the surface may be super-saturated with methane gas so, the addition of an additional gas, namely, air, changes the equilibrium in the system. The vapor sum of the methane gas and air disturbs the equilibrium and acts to further release the methane gas. Therefore, it is noted that agitation of the drilling mud 16 causes some of the release of methane gas but the substitution of air for the gas in a super-saturated solution causes further novel release of methane gas therefrom.

Or, more particularly, when during drilling operations a methane gas bearing formation is encountered, a large volume of the gas will go into solution, depending upon the ambient pressure of the hydrostatic head of the drilling fluid in the borehole above. On the way up, solubility of the gas will decrease as pressure decreases, resulting in a super-saturated solution at the surface. The introduction of air into this super-saturated system will liberate an amount of methane gas proportionate to partial pressures of the two gases and their solubility coefficients. Since a considerable quantity of methane gas is soluble in water (9 $cm^3$ per 100 ml water at 20° C.) enough volume of the methane gas can be released by this method to result in readily measurable quantities.

As noted in FIG. 2, the pump member 70 draws inlet air and any methane gas therein through the sensor head member 64. The pump member 70 discharges air through the discharge line 78 and out of the discharge head 82. The discharge air moves as shown by the arrows 84, 86 to agitate the drilling mud 16. This action greatly increases the amount of methane gas to be released and displaced which is then measured by the sensor head member 64.

Next, the electrical signal is generated by burning of the methane gas in the sensor head member 64 with the electrical signal transmitted by lines 134, 136 to the control module assembly 22. This electrical signal generated by the burning of methane gas is then amplified and transmitted by the lines 138, 140 to the recorder member 94.

The relative amount of methane gas, date and time of day is then indicated on a paper roll within the recorder member 94 in a conventional manner.

The novelty herein lies in the combination of the elongated hood housing assembly 26 and the pump assembly 30 with the known elements of (1 ) the sensing head assembly 28; (2) the control module assembly 22; and (3) the recorder assembly 24.

The volatile hydrocarbon detector apparatus achieves an accurate, continuous reading of hydrocarbons and, more particularly, methane gas in the channel of flowing drilling mud.

While the invention has been described in conjunction with preferred specific embodiments thereof, it will be understood that this description is intended to illustrate and not limit the scope of the invention, which is defined by the following claims.

I claim:

1. A volatile hydrocarbon detector apparatus, comprising:

(a) a gas sampler assembly having a hood housing assembly to straddle an open stream of continually flowing liquid material moved by a power source suspected of containing a hydrocarbon gas therein;

(b) said gas sampler assembly includes a sensing head assembly mounted in said hood housing assembly having a sensor head member to receive hydrocarbon gas and generate a first output signal therefrom with the strength of said first output signal dependent on the amount of hydrocarbon gas present;

(c) a recorder assembly connected to said sensor head member to receive said first output signal therefrom to continuously indicate the amount of hydrocarbon gas in said stream of flowing liquid material;

(d) said gas sampler assembly includes a pump assembly;

(e) said pump assembly includes an air discharge assembly; and (f) said air discharge assembly includes a discharge head adapted to be submerged in said stream of flowing liquid material to supply air under pressure thereto to aid in release of any hydrocarbon gas therein for detection by said sensor head member.

2. A volatile hydrocarbon detector apparatus as described in claim 1, wherein:

(a) said discharge head positioned within the outer periphery of said gas sampler assembly and having a plurality of holes therein to achieve substantial agitation in said stream of flowing liquid material to release the hydrocarbon gas therein.

3. A volatile hydrocarbon detector apparatus as described in claim 1, wherein:

(a) said pump assembly includes a pump member having an air inlet line connected to said sensor head member to draw inlet air with any hydrocarbon gas therewith for measurement by said sensor head member.

4. A volatile hydrocarbon detector apparatus, comprising:

(a) a gas sampler assembly to straddle an open stream of continually flowing liquid material suspected of containing a hydrocarbon gas therein;

(b) said gas sampler assembly includes a sensing head assembly mounted in said hood housing assembly having a sensor head member to receive hydrocarbon gas and generate a first output signal therefrom with the strength of said first output signal dependent on the amount of hydrocarbon gas present;

(c) a recorder assembly connected to said sensor head member to receive said first output signal therefrom to continuously indicate the amount of hydrocarbon gas in said stream of flowing liquid material;

(d) said gas sampler assembly includes a pump assembly;

(e) said pump assembly includes an air discharge assembly;

(f) said air discharge assembly includes a discharge head adapted to be submerged in said stream of flowing liquid material to supply air under pressure thereto to aid in release of any hydrocarbon gas therein for detection by said sensor head member; and (g) said discharge head positioned within the outer periphery of said gas sampler assembly and having a plurality of holes therein to achieve substantial agitation in said stream of flowing liquid material to release the hydrocarbon gas therein.

5. A folatile hydrocarbon detector apparatus as described in claim 4, wherein:

(a) said pump assembly includes a pump member having an air inlet line connected to said sensor head member to draw inlet air with any hydrocarbon gas therewith for measurement by said sensor head member.

* * * * *